US007713002B2

(12) United States Patent
Stoetzer

(10) Patent No.: US 7,713,002 B2
(45) Date of Patent: May 11, 2010

(54) DRILLING DEVICE AND METHOD FOR PRODUCING A DRILLING COLUMN IN THE SOIL

(75) Inventor: Erwin Stoetzer, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 210 days.

(21) Appl. No.: 11/790,689

(22) Filed: Apr. 26, 2007

(65) Prior Publication Data

US 2007/0267224 A1 Nov. 22, 2007

(30) Foreign Application Priority Data

Apr. 26, 2006 (EP) ..... 06008683

(51) Int. Cl.
*E21B 27/00* (2006.01)
*E02D 5/36* (2006.01)

(52) U.S. Cl. ..... 405/233; 175/308

(58) Field of Classification Search ..... 175/122, 175/315, 308, 162; 405/233
See application file for complete search history.

(56) References Cited

U.S. PATENT DOCUMENTS

| | | | | |
|---|---|---|---|---|
| 3,303,656 A | | 2/1967 | Landau | |
| 3,604,214 A | * | 9/1971 | Turzillo | 405/241 |
| 3,831,159 A | * | 8/1974 | Parsons | 340/617 |
| 5,875,860 A | * | 3/1999 | Coelus | 175/323 |
| 6,517,292 B1 | * | 2/2003 | Landau | 405/233 |
| 2003/0123937 A1 | | 7/2003 | Landau | |

FOREIGN PATENT DOCUMENTS

| | | |
|---|---|---|
| EP | 0 831 180 A1 | 3/1998 |
| EP | 1 580 325 A1 | 3/2004 |
| EP | 1580325 B1 | 9/2005 |
| GB | 1 391 109 | 4/1975 |
| GB | 1391109 | 4/1975 |
| JP | 4923408 | 3/1974 |
| JP | 547709 | 1/1979 |
| JP | 59220521 A | 12/1984 |
| RU | 2 167 097 | 5/2001 |
| RU | 2167097 | 5/2001 |

OTHER PUBLICATIONS

European Search Report (EP 06 00 8683); Aug. 10, 2006.

* cited by examiner

*Primary Examiner*—David J Bagnell
*Assistant Examiner*—James G. Sayre
(74) *Attorney, Agent, or Firm*—Jacobson Holman PLLC

(57) ABSTRACT

The invention relates to a drilling device for producing a drilling column in the soil comprising a mast, a drill drive arranged on a carriage, which is movably supported along the mast, a drilling tube which can be driven in a rotating manner by the drill drive and is movable along the mast in order to produce a drill hole, and a tube hopper that is connected to the drilling tube and comprises a storage space for filling material to fill the drill hole during the extraction of the drilling tube. In accordance with the invention provision is made for the tube hopper to be arranged in the drilling direction above the drill drive and to be connected to the drilling tube. The invention further relates to a method for producing a drilling column in the soil.

11 Claims, 4 Drawing Sheets

DRILLING DEVICE AND METHOD FOR PRODUCING A DRILLING COLUMN IN THE SOIL

BACKGROUND OF THE INVENTION

1. Field of the Invention

The invention relates to a drilling device for producing a drilling column in the soil, comprising a mast, a drill drive arranged on a carriage, which is movably supported along the mast, a drilling tube, which can be driven in a rotating manner by the drill drive and is movable along the mast in order to produce a drill hole, and a tube hopper, which is connected to the drilling tube and comprises a storage space for filling material to fill the drill hole during the extraction of the drilling tube.

The invention further relates to a method for producing a drilling column in the soil, in which a drilling tube is introduced in a rotating manner into the soil by means of a drill drive arranged on a carriage, which can be moved along a mast in a drilling direction, and on reaching a desired depth the drilling tube is extracted and the drill hole is filled with filling material from a tube hopper via the drilling tube.

2. Related Art

A generic device and a generic method are known from EP 1 580 325 A1. This printed publication discloses a construction apparatus having a mast, on which a rotary drive is movable in the longitudinal direction. On the underside of the rotary drive a multi-part drill tubing is arranged. In an upper portion of the drill tubing a tube hopper is provided, which serves to receive filling material, which can be introduced via the tubing into the hollow space developed during the extraction of the drill tubing.

According to EP 1 580 325 A1 provision is made for the multi-part drill tubing to be extracted in several steps. Through an upward movement of the carriage on the mast a tubing section is extracted from the soil and removed thereafter, while the carriage is moved downwards again and connected to the tube section lying below. The length of the tube section extracted in each step and consequently the working speed are restricted by the stroke of the carriage and therefore by the length of the mast.

A further drilling device with a tube hopper is disclosed by U.S. Pat. No. 5,647,690.

SUMMARY OF THE INVENTION

The object of the invention is to provide a generic drilling device and a generic method, which permit a particularly high working speed whilst being highly versatile and economical.

In accordance with the invention the object is solved by a drilling device having a mast, a drill drive arranged on a carriage, which is movably supported along the mast, a drilling tube, which can be driven in a rotating manner by the drill drive and is movable along the mast in order to produce a drill hole, and a tube hopper, which is connected to the drilling tube and comprises a storage space for filling material to fill the drill hole during the extraction of the drilling tube, wherein the tube hopper is arranged in the drilling direction above the drill drive and is connected to the drilling tube; and a method in which a drilling tube is introduced in a rotating manner into the soil by means of a drill drive arranged on a carriage, which can be moved along a mast in a drilling direction, and on reaching a desired depth the drilling tube is extracted and the drill hole is filled with filling material from a tube hopper via the drilling tube, wherein the tube hopper is arranged on the carriage in a torque-proof manner thereto and is moved therewith.

The drilling device according to the invention is characterized in that the tube hopper is arranged in the drilling direction above the drill drive and is connected to the drilling tube.

A fundamental idea of the invention resides in the fact that the tube hopper is arranged on the upper side of the drill drive, which faces away from the drilling tube and in particular from its tip, whereby it is possible to advance the drilling tube directly towards the drill drive without requiring any elements lying in-between for storing filling material.

Compared to the prior art, according to which the tube hopper is provided below the rotary drive, it is therefore possible in accordance with the invention to move the drill drive with the carriage closer to the edge of the drill hole without this movement being obstructed by the tube hopper. Whilst having the same mast length the possible stroke of the carriage is therefore increased so that longer drilling tube sections can be employed. Consequently, the number of required installation and de-installation processes of drilling tube sections is reduced and the working speed is increased.

In principle, it is possible to arrange the tube hopper to rotate with the drilling tube, whereby a drilling device with a particularly simple construction is created. However, a particularly preferred embodiment resides in the fact that the tube hopper is connected in a rotation-proof manner to the carriage and is supported in a manner to allow rotation of the drilling tube relative thereto. This allows for a particularly easy filling of the tube hopper, since its position is not changed during the drilling operation. It is suitable for the tube hopper to be connected directly to the carriage.

For an especially versatile operation it is suitable for the drilling tube to be designed of several parts, in which case the individual tube sections are connected to one another by detachable couplings. In this way it is possible to build e.g. a reinforcing cage into the drilling tube, which is then introduced together with the filling material into the soil through the lower end of the drilling tube.

Especially when making use of drilling tubes that consist of several parts it is of advantage that a closing device is provided, by which a passage for filling material from the tube hopper to the drilling tube can be closed. The closing device can be provided for example above the drill drive, more particularly between the tube hopper and the drill drive. It has a locking flap in particular. Alternatively or additionally a closing device can also be arranged below the drill drive.

Advantageously, the working stroke of the drilling device can be enhanced further in that the tube hopper can be moved axially, especially together with the drilling tube, and fixed with respect to the carriage. For instance a linear drive can be provided on the carriage for the movement of the tube hopper.

The versatility of the drilling device according to the invention can be increased in that below the rotary drive the drilling tube is coupled in a manner to rotate with and in a detachable manner to an output shaft of the rotary drive. To this end a detachable drill tube coupling can be provided.

An especially reliable operation of the drilling device is rendered possible in that a filling level sensor is provided in the tube hopper. More particularly, the filling level sensor can have a display device, which is spaced from the tube hopper. The filling level sensor can include an ultrasonic sensor for example.

A drilling device with an especially simple construction is provided in that the output shaft of the drill drive is designed as a hollow shaft, on the one side of which the drilling tube extends at least in sections and on the other side of which the tube hopper is arranged. In this case the transport of filling material between tube hopper and drilling tube can take place in a particularly easy way through the hollow shaft. For the introduction of the torque the output shaft can be toothed, for example, more particularly a toothed spline.

Furthermore, in accordance with the invention the tube hopper has a substantially cylindrical storage portion, below which a substantially conical outlet portion is arranged. The drilling tube can be connected to this conical outlet portion in particular via the output shaft. The tube hopper has a funnel-shaped design and is open at the top. It can also have a cover.

The method according to the invention is characterized in that the tube hopper is arranged on the carriage in a rotation-proof manner thereto and is moved therewith. The method can be carried out in particular with a drilling device in accordance with the invention, whereby the advantages set out in this connection can be attained.

In particular, a tube hopper can mean a filling material storage device, which can be attached to a drilling tube in extension, i.e. axial direction of the drilling tube, preferably in a coaxial manner.

BRIEF DESCRIPTION OF THE DRAWINGS

In the following the invention will be described in greater detail by way of preferred embodiments which are shown schematically in the Figures, wherein.

Elements having the same or analogous functions are designated throughout the Figures with the same reference signs.

DETAILED DESCRIPTION OF THE PREFERRED EMBODIMENTS

Figure 1:
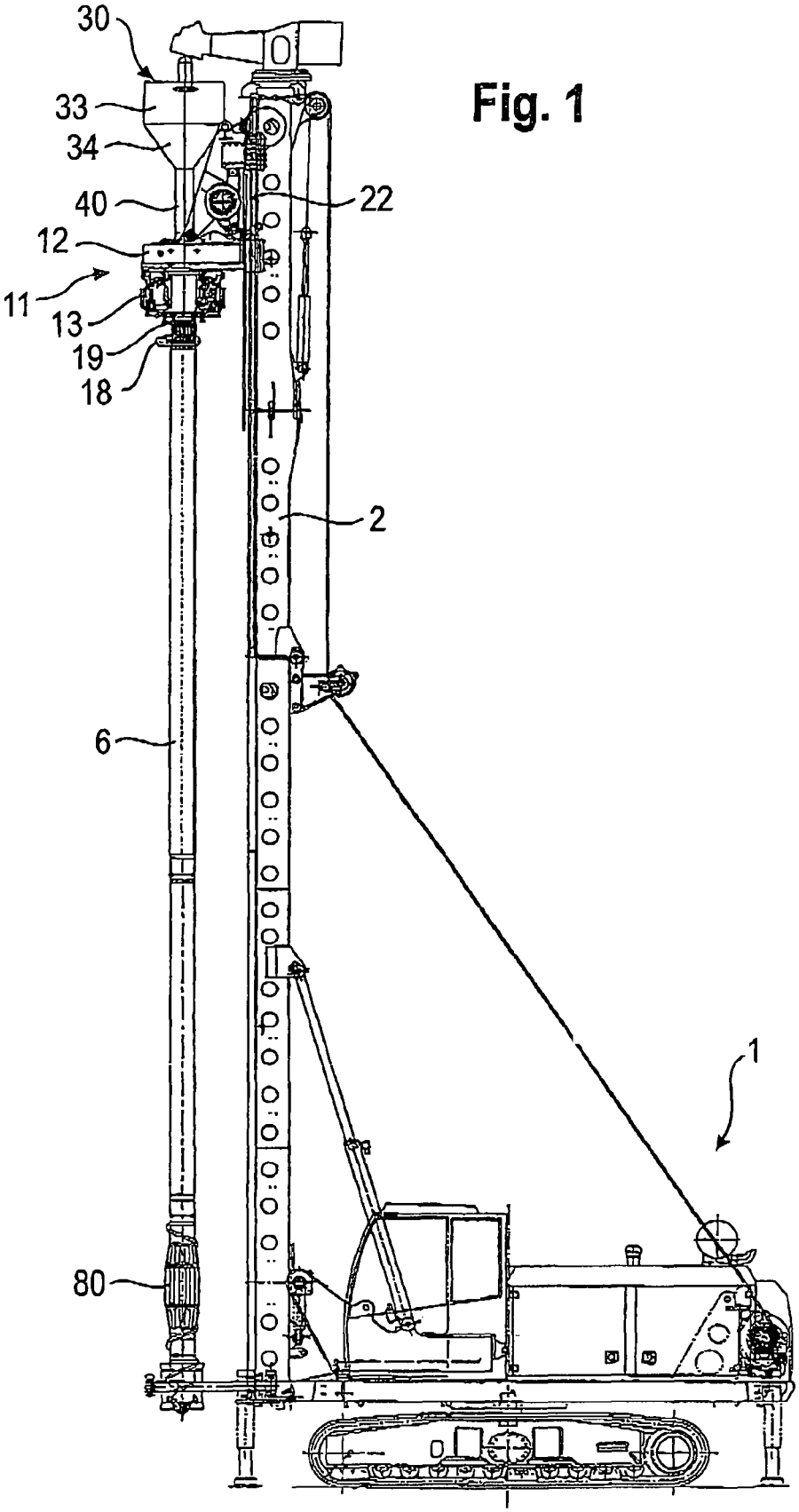
FIG. 1 shows a first embodiment of a drilling device according to the invention.

A first embodiment of the drilling device according to the invention is shown in FIG. 1. The drilling device has a chassis 1, on which a mast 2 is arranged in a pivotable manner. On the mast 2 a carriage 22 is provided, which is movable in a drilling direction along the mast 2.

On the carriage 22 a drill drive 11 designed as a rotary drive is provided, at the output shaft 19 of which a drilling tube 6 is arranged in a manner for rotation therewith and e.g. in an axially fixed manner. By operating the drill drive 11 the drilling tube 6 can be set into rotation. Through a movement of the carriage 22 the drilling tube 6 can be moved axially by means of the drill drive 11 in the drilling direction. The drilling tube 6 is coupled to the output shaft 19 through a detachable tube coupling 18 arranged on a lower end of the output shaft 19.

The drilling tube 6 is designed of several parts comprising a number of tube elements, which are connected to one another by detachable tube couplings. At the bottom of the drilling tube 6 a displacement drilling head 80 is provided.

The drill drive 11 has a drive part 12, in which a hydraulic rotary motor is arranged, as well as a ring-shaped gear part 13 arranged at the bottom of the said drive part, which serves to transmit the torque from the hydraulic motor to the drilling tube 6.

For the storage of filling material a tube hopper 30 is provided above the drilling tube 6 in the extension of its longitudinal axis. The tube hopper 30 has a cylindrical storage portion 33 for receiving filling material, which is followed underneath by a conical outlet portion 34. The tube hopper 30 is arranged above the drill drive 11 and the carriage 22, i.e. on the side facing away from the drilling tube 6 and in particular from the tip of the drilling tube 6. Therefore the drill drive 11 can be moved towards the soil as far as the tube coupling 18, that is the drill drive 11 can be moved down to the soil surface with the tube coupling 18.

For the introduction of filling material from the tube hopper 30 into the drilling tube 6 an extension tube 40 is arranged at the bottom of the outlet portion 34 of the tube hopper 30. This extension tube 40 runs centrally through the drive part 12, the gear part 13 and the output shaft 19 of the drill drive 11, which is designed as a hollow shaft, and merges into the drilling tube 6. Hence, the filling material can be introduced from the tube hopper 30 through the extension tube 40 and the output shaft 19 into the drilling tube 6.

To permit a rotational decoupling of the tube hopper 30 from the drilling tube 6 e.g. a rotary coupling, which can also be referred to as a flush joint, may be provided on the extension tube 40.

The tube hopper 30 depicted in FIG. 1 can be height-adjustable with regard to the carriage 22 and the drill drive 11, i.e. it can be supported on the carriage 22 in an axially adjustable manner in the drilling direction. For an active adjustment the connecting tube 40 may be designed for example as a Kelly bar that has longitudinal ribs for the torque transmission and locking pockets for applying axial forces.

Figure 2:
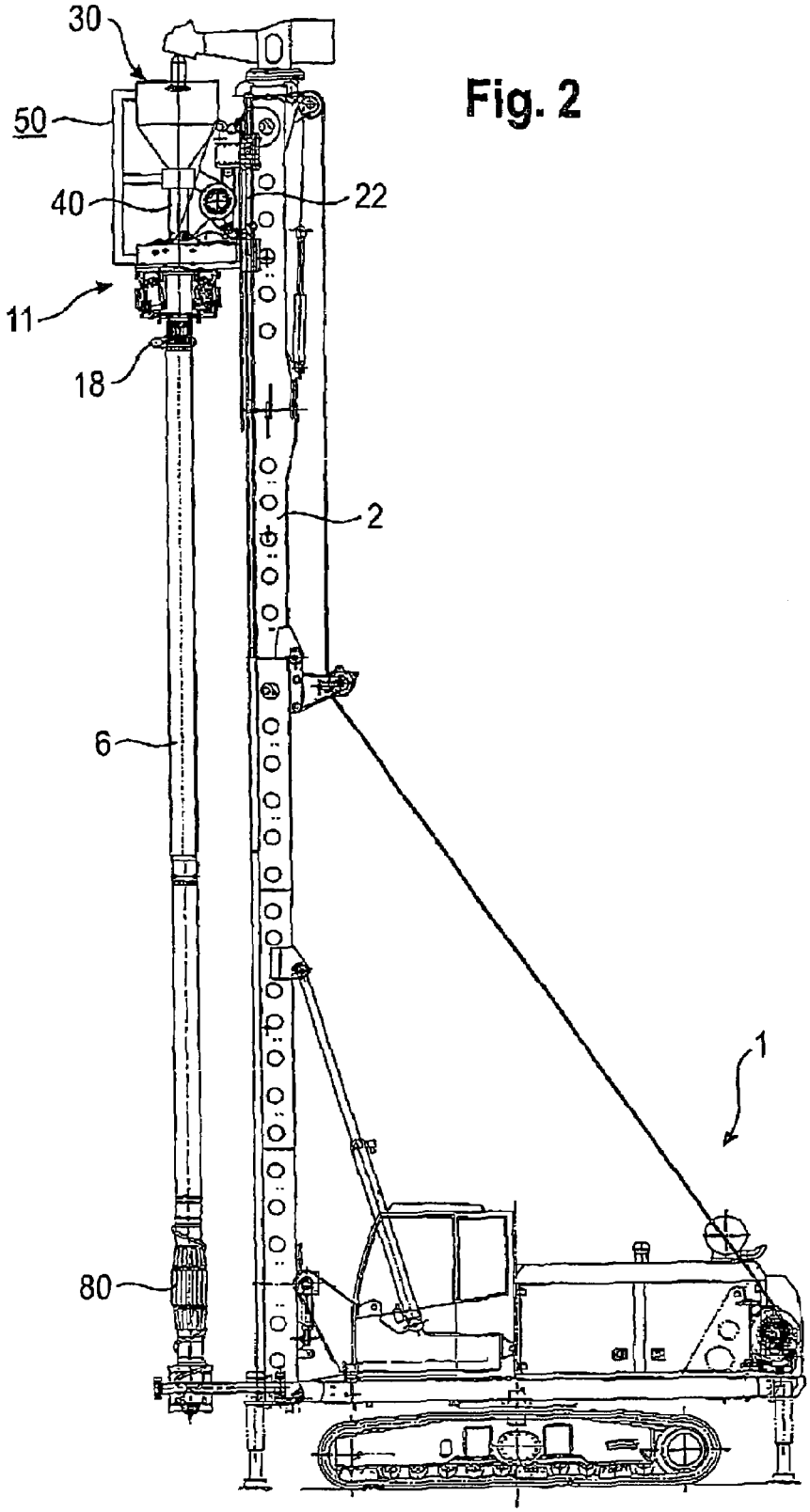
FIG. 2 shows a second embodiment of a drilling device according to the invention.
Figure 3:
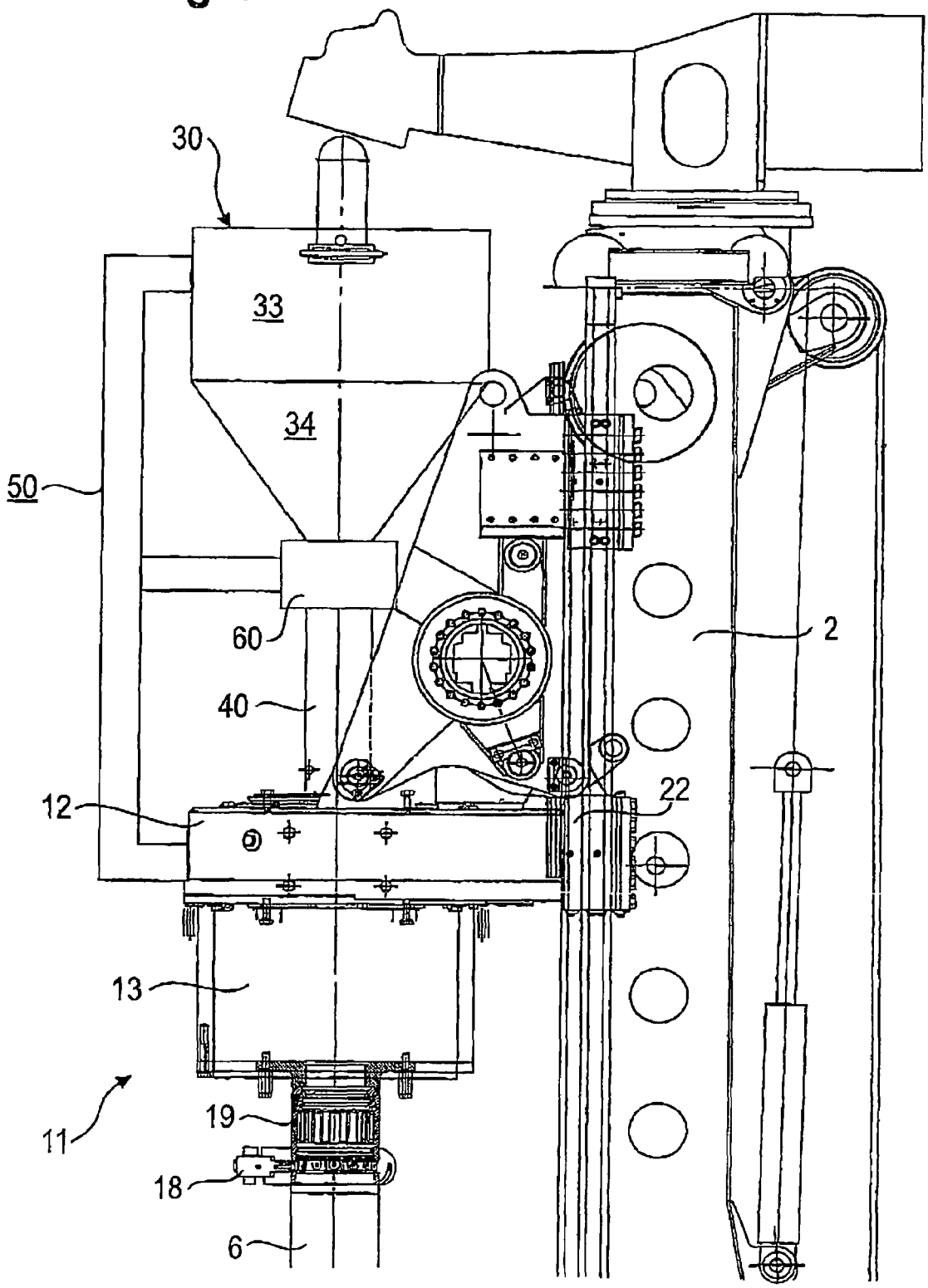
FIG. 3 shows a detailed view of the drilling device from FIG. 2 in the portion of the drill drive.

Another embodiment of the drilling device according to the invention is shown in FIGS. 2 and 3. The embodiment of FIGS. 2 and 3 mainly differs from the embodiment of FIG. 1 in that a support 50 is provided that is located so as to connect the carriage 22 and in particular the drill drive 11 on the one hand with the tube hopper 30 on the other hand and extends in the drilling direction for rotation-proof support of the tube hopper 30 and preferably also for the active height adjustment of the tube hopper 30.

In accordance with the embodiment of FIGS. 2 and 3 a rotary coupling 60 is arranged on the connecting tube 40 between the drilling tube 6 and the tube hopper 30. The rotary coupling is retained by a lateral arm of the support 50. It permits a rotational decoupling of the drilling tube 6 from the tube hopper 30. By means of the support 50 the tube hopper 30 is rotation-proof with regard to the drill drive 11 and the carriage 22.

Figure 4:
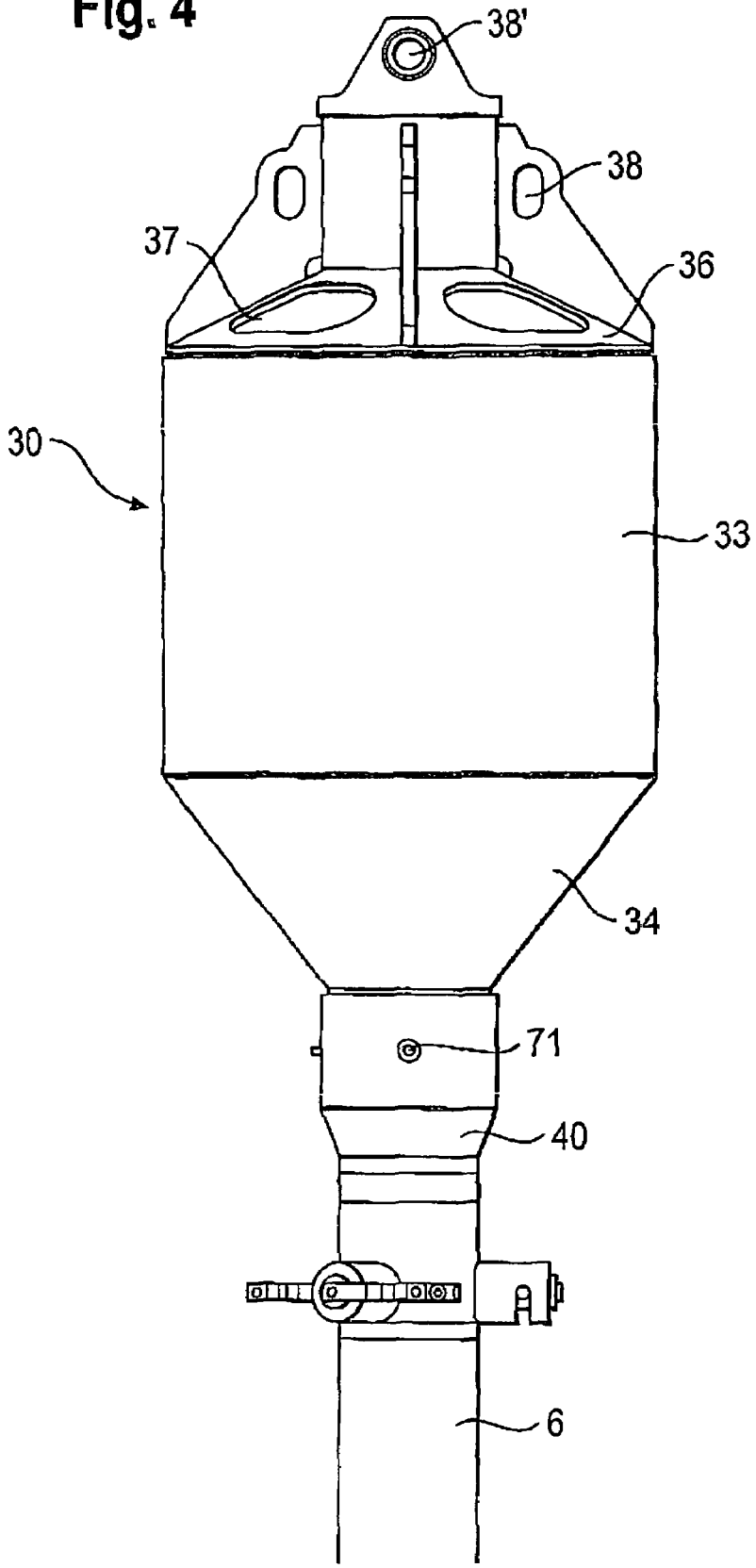
FIG. 4 shows a tube hopper for use in a drilling device according to the invention.

A further embodiment of a tube hopper 30 for use in a drilling device according to the invention is shown in FIG. 4. The tube hopper 30 of FIG. 4 is closed at the upper end of the storage portion 33 by a conical cover 36. In the cover 36 filling holes 37 for the filling of filling material into the storage portion 33 are provided. Furthermore, on the cover 36 various eyelets 38, 38' are provided for lifting the cover 36 and/or the tube hopper 30 by means of an auxiliary crane.

On the outlet side of the tube hopper 30 a closing device 71 designed as a flap is provided on the connecting tube 40 for blocking the flow of filling material between tube hopper 30 and drilling tube 6.

The invention claimed is:

1. A drilling device for producing a drilling column in the soil comprising:

a mast, a carriage movably supported along the mast, a drill drive arranged on the carriage, a drilling tube drivable in a rotating manner by the drill drive and movable along the mast in order to produce a drill hole, a tube hopper including a storage space for filling material to fill the drill hole during the extraction of the drilling tube, the tube hopper being arranged above the drill drive relative to the direction of drilling, connected in a rotation-proof manner to the carriage, and coupled to the drilling tube in a manner to permit rotation of the drilling tube relative thereto, and a support supporting the tube hopper in rotation-proof manner, wherein the support directly connects the tube hopper to the drill drive in a rotation-proof manner and indirectly connects the tube hopper to the carriage in a rotation-proof manner via the drill drive.

2. Drilling device according to claim 1, further comprising a passage for filling material connecting the tube hopper to the drilling tube and a closing device for closing the passage for filling material between the tube hopper to the drilling tube.

3. Drilling device according to claim 1, wherein the tube hopper is movable axially and fixable with respect to the carriage.

4. Drilling device according to claim 1, wherein the drill drive includes an output shaft, and wherein below the drill drive the drilling tube is connected in a manner to rotate with and in a detachable manner to the output shaft of the drill drive.

5. Drilling device according to claim 1, wherein a filling level sensor is provided for measuring a filling level in the tube hopper.

6. Drilling device according to claim 1, wherein the output shaft of the drill drive is designed as a hollow shaft, on the one side of which the drilling tube extends at least in sections and on the other side of which the tube hopper is arranged.

7. Drilling device according to claim 1, wherein the tube hopper has a substantially cylindrical storage portion, below which a substantially conical outlet portion is arranged.

8. A method for producing a drilling column in the soil using the drilling device according to claim 1, comprising the steps of:

introducing the drilling tube in a rotating manner into the soil by means of the drill drive arranged on the carriage and moving along the mast in a drilling direction, and on reaching a desired depth, extracting the drilling tube and filling the drill hole with filling material from the tube hopper via the drilling tube.

9. Drilling device according to claim 1, wherein:

the support includes a portion extending in the drilling direction and having an upper end connected to the tube hopper for rotation-proof support of the tube hopper, a lower end connected to the drill drive, and a lateral arm intermediate the upper and lower ends, and the drilling device further includes a connecting tube connecting the tube hopper and the drilling tube, and a rotary coupling arranged on the connecting tube between the drilling tube and the tube hopper for rotational decoupling of the drilling tube from the tube hopper, the rotary coupling being retained by the lateral arm of the support.

10. Drilling device according to claim 1, wherein the support is separate and spaced from the mast.

11. A drilling device for producing a drilling column in the soil comprising:

a mast, a carriage movably supported along the mast, a drill drive arranged on the carriage, a drilling tube drivable in a rotating manner by the drill drive and movable along the mast in order to produce a drill hole, a tube hopper including a storage space for filling material to fill the drill hole during the extraction of the drilling tube, the tube hopper being arranged above the drill drive relative to the direction of drilling, connected in a rotation-proof manner to the carriage, and coupled to the drilling tube in a manner to permit rotation of the drilling tube relative thereto, and a connecting tube connecting the tube hopper and the drilling tube and a rotary coupling arranged on the connecting tube between the drilling tube and the tube hopper for rotational decoupling of the drilling tube from the tube hopper, a support supporting the tube hopper in rotation-proof manner, wherein:

the support is separate and spaced from the mast, the support includes a portion extending in the drilling direction and having an upper end connected to the tube hopper for rotation-proof support of the tube hopper, a lower end connected to the drill drive, and a lateral arm intermediate the upper and lower ends, the lateral arm retaining the rotary coupling, and the support directly connects the tube hopper to the drill drive in a rotation-proof manner and indirectly connects the tube hopper to the carriage in a rotation-proof manner via the drill drive.

* * * * *